US006269570B1

(12) United States Patent
Miles

(10) Patent No.: US 6,269,570 B1
(45) Date of Patent: Aug. 7, 2001

(54) SIGNAGE STRUCTURE

(75) Inventor: Colleen Miles, 8953 SE. Battin Rd., Portland, OR (US) 97266

(73) Assignee: Colleen Miles, Portland, OR (US)

( * ) Notice: Subject to any disclaimer, the term of this patent is extended or adjusted under 35 U.S.C. 154(b) by 0 days.

(21) Appl. No.: 09/361,661

(22) Filed: Jul. 27, 1999

(51) Int. Cl.[7] ..... G09F 15/00
(52) U.S. Cl. ..... 40/607; 40/650
(58) Field of Search ..... 40/607, 650, 661.05, 40/666, 658, 660

(56) References Cited

U.S. PATENT DOCUMENTS

| | | | | |
|---|---|---|---|---|
| 2,316,539 | | 4/1943 | Patterson . | |
| 2,327,742 | * | 8/1943 | Rosenberg | 40/607 |
| 2,616,196 | | 11/1952 | Sandahl, Jr. et al. . | |
| 2,625,762 | | 1/1953 | McColl . | |
| 3,015,899 | | 1/1962 | Ensign et al. . | |
| 3,210,875 | | 10/1965 | Schwenkler . | |
| 3,713,237 | * | 1/1973 | Thomson et al. | 40/607 |
| 3,829,999 | | 8/1974 | Bernstein . | |
| 4,347,678 | | 9/1982 | Laakso . | |
| 4,454,671 | * | 6/1984 | Morgenstern | 40/607 |
| 4,662,096 | | 5/1987 | Bayless et al. . | |
| 5,116,204 | | 5/1992 | Power et al. . | |
| 5,282,331 | | 2/1994 | Fell . | |
| 5,782,027 | * | 7/1998 | Gildes | 40/607 |
| 5,901,386 | | 5/1999 | Bragalone . | |

* cited by examiner

*Primary Examiner*—Cassandra H. Davis
(74) *Attorney, Agent, or Firm*—Owen W. Dukelow; Kolisch Hartwell Dickinson McCormack & Heuser

(57) ABSTRACT

Specific-point signage structure for use in an interior building space of the style generally divided and organized by low-wall cubicle panels—in particular where such a point can be approached and viewed from a large number of different angularly displaced locations. The signage structure is configured in such a fashion that it presents a viewing surface, such as a curved, or otherwise angularly differentiated, viewing surface, which readily conveys information to viewers distributed at widely different angular locations relative to the position of the structure.

6 Claims, 3 Drawing Sheets

SIGNAGE STRUCTURE

BACKGROUND AND SUMMARY OF THE INVENTION

A problem within building spaces where business is conducted by a large number of people working in an open, partially separated space, e.g., an open floor segmented into cubicles, or where many items are stored in an open space, on rows of shelving, e.g., in a supermarket, is locating within the space the workspace of a particular person or group of persons, or the shelf location of particular goods or type of goods. Signage is often employed to assist persons making deliveries to, or pickups at particular locations in the open space. However, the previously known signs have several drawbacks. Generally a flat sign is hung from ceiling structure with information printed on the sign about the persons or goods located near the sign. The flat sign is readable only from a viewing angle that is generally normal to the sign's face, while readability suffers greatly when the viewer is located towards the sign's edge, and the flat sign is not readable at all from the side. The flat sign often blocks the view of other signs or of other information or visual cues located throughout the open space. The ceiling mount may require retrofitting of the ceiling and requires a high ladder for installation.

This invention involves the provision of a signage structure, preferably curved or any other form that provides for a wide variety of viewing angles, that can be mounted inside a building space, or in certain outside areas if desired, with mounting being effected on the outside of something like a post or a support pillar, or on the flat wall or on the outside or within the inside of, outside and inside corner areas where walls or wall-like structures join.

The proposed signage structure includes a sign- or placard-mounting frame or placard support which can either be a single integrated unit, or various-style angle-occupying frame pieces that can be positioned adjacent one another to define an elongate curved slip-in/slip-out track for freely receiving and releasing at will different selected elongate signs, preferably flexible, or alternatively pre-formed in a fixed curved shape, matching that of the placard support.

Preferably the sign support frame structure includes an elongate, curved track with upper and lower channel-like rungs or grooves that are elongated and that extend along and throughout a predetermined angle, preferably a substantially full circle, and which include one or two open ends into which and from which a sign or placard can be inserted and/or withdrawn at will.

An aspect of the invention is that, with a curved presentation surface provided, signage held within the structure can readily be viewed from a very wide range of selected viewing angles, which viewing angles can conveniently offer a line of view from just about any vantage point occupyable within or adjacent the space where the signage structure is employed. Also, the structure of this invention affords the opportunity for a user to select predetermined, preferable lines of points of view which may relate especially to the locations where people in the relevant space might be standing to look for sign information, with the curvilinearity in the tracks provided for flexible signs affording the opportunity for a user to center (so-to-speak) the main message of the sign in the fashion which is directly aimed in what might be thought of as a normal sense relative to the central axis of each such selected point of view. The curvature of the sign also allows the same amount of information to be printed in the same size font as a flat sign, with a smaller horizontal dimension, so the curved sign blocks the view of less of the other information as compared to the flat sign.

The sign support structure can readily be made to suit any mounting application, and preferably will be formed of any suitable lightweight metal or plastic or other easily shaped, formed and configured materials.

DETAILED DESCRIPTION OF THE PREFERRED EMBODIMENT

Figure 1:
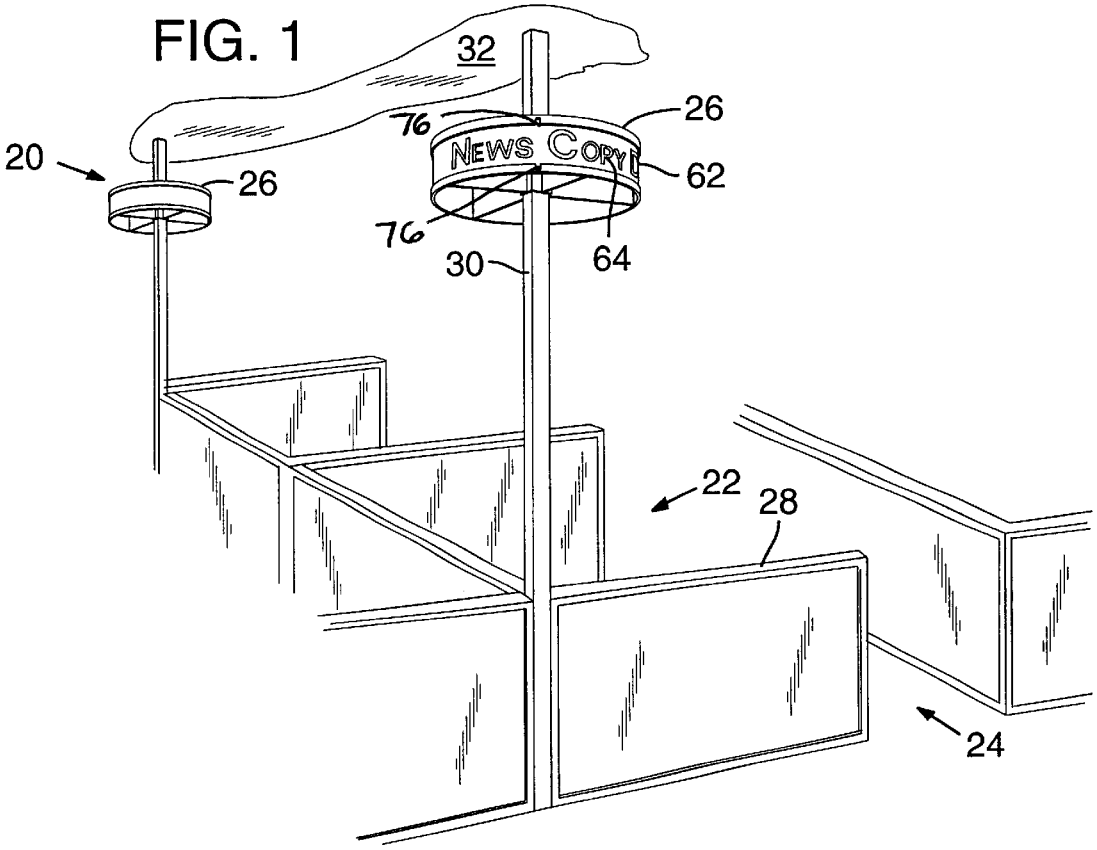
FIG. 1 is an isometric view of an open space within a building partitioned into cubicles with vertical posts extending from the cubicles to the ceiling, the posts providing conduits for power and other electrical wiring, and two full-circular signage structures according to the present invention mounted on two of the posts showing that the signs are useful to indicate at a distance the function of the persons located near each of the signs.

As shown in FIG. 1, an open space 20, typically within a building with a generally open floor plan, may be partitioned into a plurality of individual or group work areas 22, or cubicles, and walkways 24, if used for work or space 22 may be partitioned into storage locations, e.g., rows of shelving, if used as storage space, or into a combination of work and storage space. A person entering space 22 with a task of delivering an item to a particular person or group within space 22 can navigate to the correct location as indicated on one or more signage structures 26 that identify the person or group in the area of the sign. Typical cubicle partitions are constructed from interconnectable walls 28 and a plurality of vertical posts 30 that serve as conduits for power, telephone, computer, and other electrical wires that are routed from the workstations within the cubicles up posts 30 to ceiling 32 for routing to their eventual destinations. Electrical codes may prohibit making holes in posts 30 and any objects, particularly metal, piercing or being inserted into posts 30 because of potential damage to the wires within and consequent shorting danger.

Figure 2:
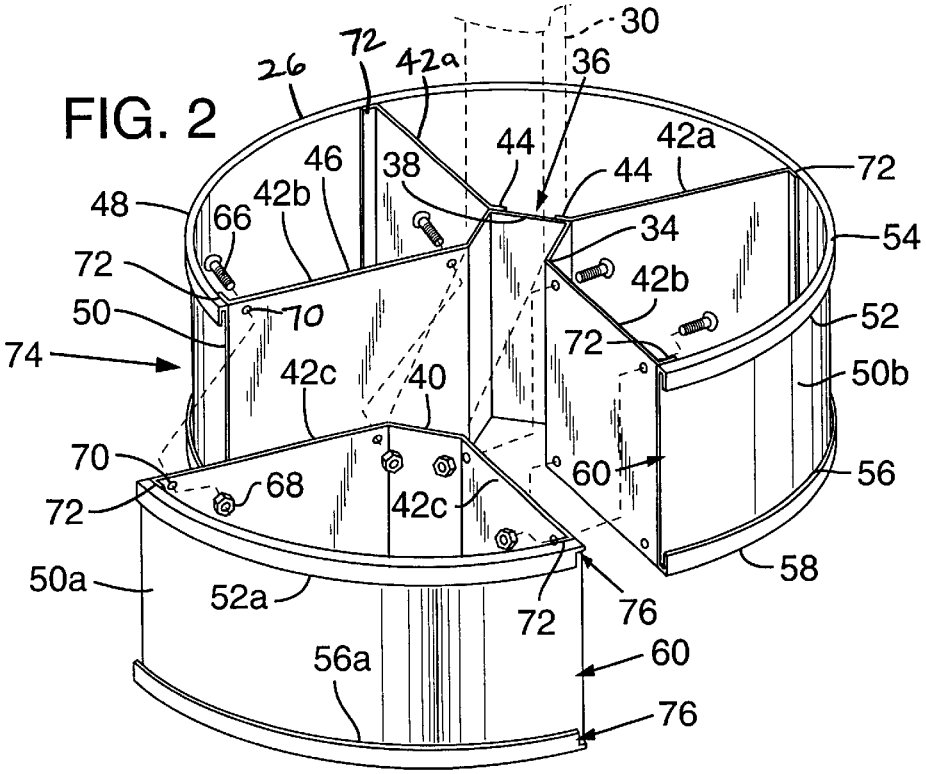
FIG. 2 is an isometric view of the full-circular signage structure, showing an alternative embodiment for mounting the sign to the post wherein the structure includes a three-quarters section and a one quarter section removable from the three-quarter section to provide access to a mounting bracket to mount about the post.

An embodiment of signage structure 26, shown in FIG. 2, which may be formed of any suitable material such as molded plastic or, more preferably, pressed metal pieces welded together, includes a mount 34 configured to fit closely about post 30 and having a square-cross-sectioned opening 36 defined by a three-flat-sided piece 38 and a separable piece 40 providing a fourth side to complete the square opening. Six horizontally extending members 42*a, b* & *c* are welded at an inner tab 44 to mount 34, as shown for members 42*a*, or formed integrally with mount 34, as shown for members 42*b* and 42*c*.

The horizontal members 42 and mount 34 together form a bracket 46 for mounting signage structure 26 to a fixed structure such as post 30. Bracket 46 can have any form suitable for mounting signage structure 26 to any fixed structure or stand, or may include an integrally formed stand. Bracket 46 also could be used to couple signage structure to hooks for hanging from a ceiling or other overhead structure.

Bracket 46 is coupled to a placard support 48, which is formed of an elongate, thin, preferably metal band 50 pressed and bent into a curved, hoop-like shape, and having an upper lip 52 adjacent and running parallel to an upper edge 54 of band 50, and a lower lip 56 adjacent and running parallel to lower edge 58 of band 50. Band 50 and upper and lower lips 52, 56 together form a curved track 60 for slidably receiving a sign or placard 62, shown in FIGS. 1 and 10, which is preferably pre-printed with information visible on a face 64 of placard 62 and formed of nominally flat, flexible plastic material so that it can conform to curved track 60. Placard 62 may alternatively be preformed in a shape conforming to curved track 60.

Placard 62 preferably is about as long as the circumference of band 50, and thus subtends substantially a full circle when installed in track 60, and has a width and depth appropriate for fitting into curved track 60 and being held in place by lips 52, 56. When placard 62 is in place in curved track 60, it preferably remains adjustable within placard support 48, even while signage structure 26 is mounted to post 30, so that a user can move placard 62 about placard support 48 to present the information for viewing from a plurality of selectable viewing angles, preferably throughout the substantially full circle.

As shown in FIG. 2, the alternative embodiment includes a quarter section 50*a* with upper and lower lips 52*a*, 56*a* of placard support 48 formed separately from a three-quarter section 50*b* of band 50, and removably attached to the rest of placard support 48 by eight nuts and bolts 66, 68 coupling horizontal members 42*b* to horizontal members 42*c* through holes 70. Members 42*a* and 42*b* are preferably welded to three-quarter section 50*b* at outer tabs 72 and members 42*c* are welded to onequarter section 50*a* at outer tabs 72. When one-quarter section 50*a* is removed from placard support 48 it opens an access channel 74 through which post 30 can pass, allowing installation of the mount about the post. In FIG. 2, a notch 76 is shown in upper lip 52*a* and lower lip 56*a* to allow placard 62 to be inserted into track 60 while signage structure 26 is installed on post 30, but the notch may be formed at any location along lips 52*a*, 56*a*, or lips 52, 56.

Figure 3:
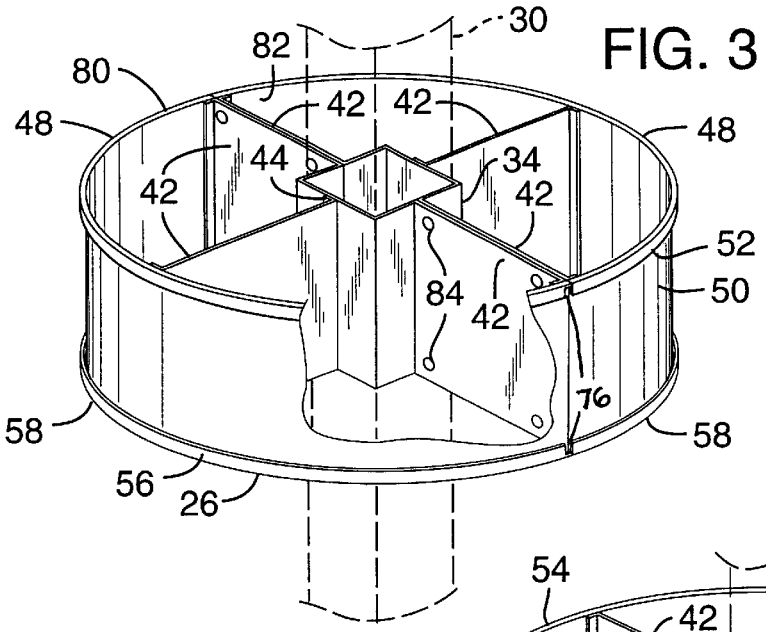
FIG. 3 is an isometric view of the full-circular signage structure, showing an alternative embodiment wherein the structure includes two half sections mountable about the post.

Another alternative embodiment for signage structure 26 is shown in FIG. 3, which is substantially the same as that of FIG. 2, but where placard support 48 is formed of two half-circle-sections 80, 82 coupled to horizontal members 42 which can be coupled with nuts and bolts (not shown) through holes 84. In this embodiment, as for that of FIG. 2, there are a total of six horizontal members 42 coupling mount 34 to placard support 48.

Figure 4:
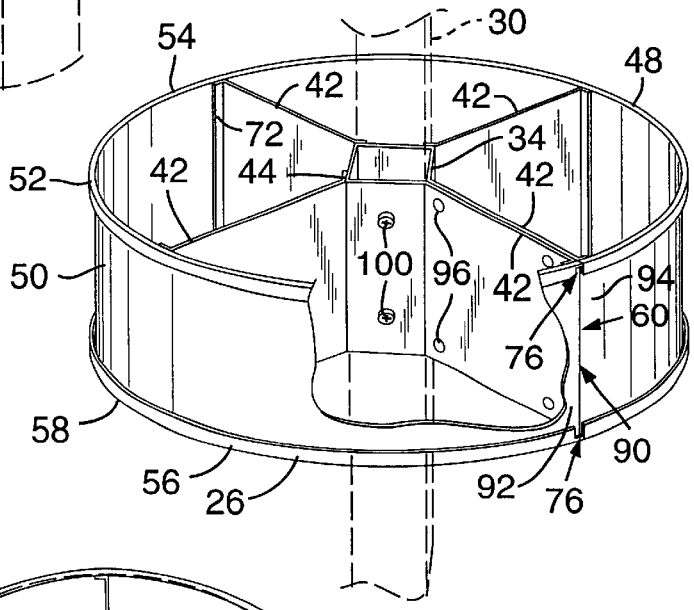
FIG. 4 is an isometric view of the full-circular signage structure, showing the preferred embodiment with a nominally closed access channel providing access to the central mounting bracket.
Figure 5:
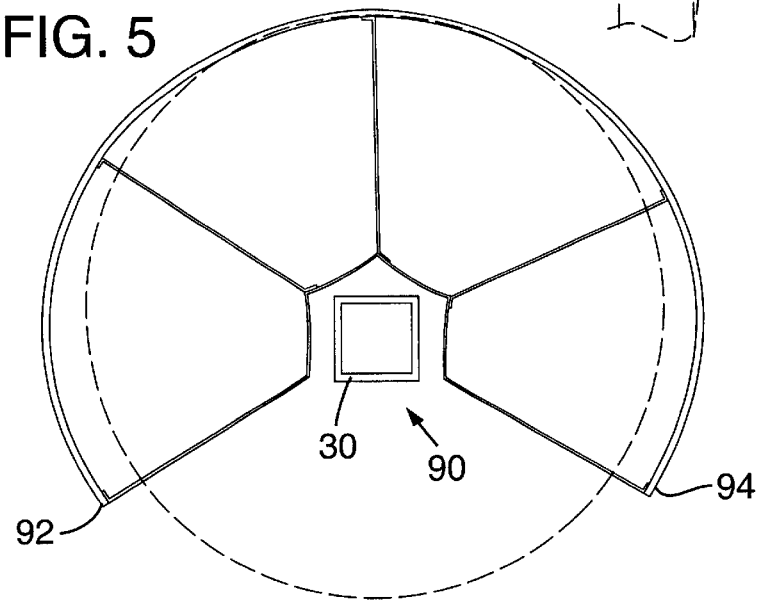
FIG. 5 is a plan view of the structure of FIG. 4 wherein the structure has been flexed or bent apart temporarily to slip the structure around the post.
Figure 6A:
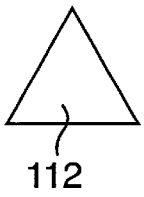
FIGS. 6A–D show cross-sections of variously-shaped posts that the structure of the present invention can be configured to accommodate, including triangular, hexagonal, circular, and rectangular.
Figure 6B:
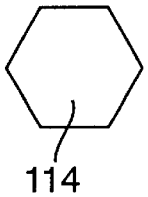
Figure 6C:
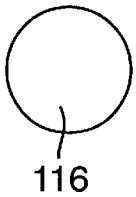
Figure 6D:
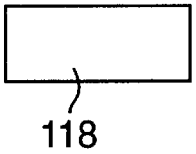

A simpler construction with only five horizontal members 42 is realized in the preferred embodiment shown in FIG. 4, where band 50 is formed in a single section with a nominally closed access channel 90 formed where ends 92, 94 of band 50 meet. As shown in FIG. 5, signage structure 26 with this construction can be installed on post 30 by the installer's flexing band 50 to spread apart ends 92, 94 and opening access channel 90 enough to allow post 30 to be passed through. Then, the installer allows the band to return to its nominal shape and bolts the horizontal members together at holes 96, and placard 62 can be installed through notches 76 into curved track 60. Preferably, one or more set screws 100 adjustably installed in threaded holes in mount 34 are used to grip the post without piercing it, so that signage structure 26 is affixed to post 30. If the height on post 30 of signage structure 26 is later decided to be changed, a user can easily do so by loosening set screws 100 and sliding signage structure 26 up or down and re-tightening screws 100. If electrical codes do not prohibit it, the signage structure 26 may alternatively be attached to post 30 by screws that do pierce post 30.

As shown in FIGS. 6A–6D, post 30 may have any cross-sectional shape including triangular 112, hexagonal 114, circular 116 or rectangular 118, and it will be understood that mount 34 can be re-configured to mate with any of these shapes.

Figure 7:
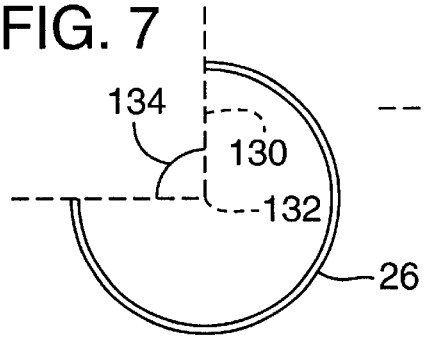
FIG. 7 is a plan view of an alternative embodiment of the invention providing the circular shape of the other embodiments for mounting at an outside corner of a wall.
Figure 8:
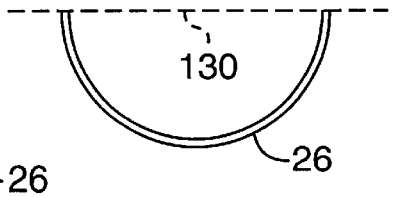
FIG. 8 is an embodiment of the invention similar to that of FIG. 7, but for mounting to a substantially flat wall.
Figure 9:
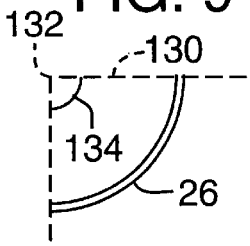
FIG. 9 is an embodiment of the invention similar to that of FIGS. 7 and 8, but for mounting to an inside corner.

An alternative embodiment for signage structure 26 mountable to a wall 130 is shown in FIGS. 7–9. Signage structure 26 as shown in FIG. 7 is for mounting on wall 130 at a corner 132 which presents a comer angle 134 of about 270-degrees, while signage structure 26 as shown in FIG. 9 is for mounting on wall 130 at corner 132 with corner angle 134 of about 90-degrees. Alternatively, FIG. 8 shows signage structure 26 mounted to wall 130 which is substantially flat and signage structure subtending a curve of about 180-degrees. In each of these embodiments, signage structure 26 supports a placard which includes a face with information visible thereon, as for the other embodiments, and the placard curves to subtend substantially the entire corner angle. It will be understood that bracket 46 (not shown in FIGS. 7–9) may readily be modified to support these embodiments and to mount signage structure 26 to wall 130.

Figure 10:
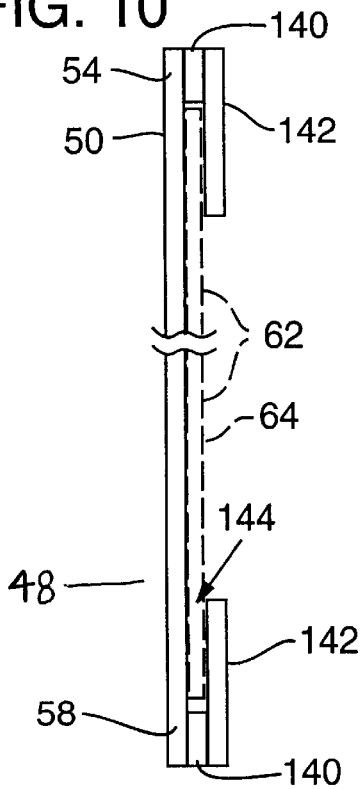
FIG. 10 is a cross-sectional view of the signage structure including a track with upper and lower grooves for slidably receiving a flexible or a pre-shaped placard, the grooves formed by a flat metal band, two small strips affixed, as by welding, one to each of a lower and an upper edge of the flat band, and two larger strip affixed one to each of the small strips, the larger strips and the band defining therebetween a pair of grooves bounded above and below by the small strips, the grooves and band defining a track for slidably receiving a placard, shown for reference in dashed lines.

FIG. 10 is a cross-sectional view of placard support 48 showing the preferred construction where band 50 has coupled to it at upper and lower edges 54, 58 an inner pair of thin, elongate strips 140, preferably metal, but alternatively of any suitably strong and flexible material. Inner strips 140 act as spacers for a pair of larger, thin, elongate, outer strips 142 coupled to inner strips 140. Strips 140, 142 may be coupled by welding, pop rivets, or any manner suitable for their material. FIG. 10 shows that strips 140, 142, together with band 50 formed curved track 60, which includes curved grooves 144 defined between outer strips 142 and band 50. Placard 62 is shown in dotted lines in FIG. 10 to show the clearance for grooves 144 and how the placard fits into curved track 60, and also to show that placard 62 may be used as a template or temporary structure during construction of placard support to maintain the proper clearance in track 60 and grooves 144.

Figure 11:
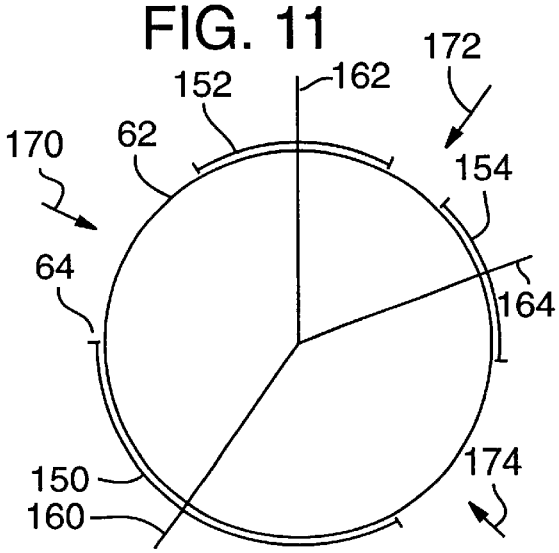
FIG. 11 illustrates in plan view a full-circular arrangement of the signage structure in which three representations of information printed on the placard are illustrated in three different angular locations around the axis of curvature of the circular signage structure, with radial lines indicating the viewing angle normal to each piece of printed information, and arrows indicating viewing angles from which enough of two of the pieces of information may be perceived to understand the meaning of both pieces.

FIG. 11 shows that three pieces of information visible on face 64 of placard 62, the information represented by bounded lines 150, 152, 154, may each be best viewed from a viewing angle running along radial lines 160, 162, 164, and placard 62 may be rotated within the placard support to any position to best support perception of the information from the most likely viewing angles. For any given position of placard 62, a person viewing placard 62 along off-normal viewing angles, represented by arrows 170, 172, 174, may still be able to perceive enough of two pieces of the information to understand the message intended to be imparted by the sign, and to proceed accordingly.

While the present invention has been shown and described with reference to the foregoing preferred and alternative embodiments, it is to be understood by those skilled in the art that other changes in form and detail may be made therein without departing from the spirit and scope of the invention as defined in the appended claims.

It is claimed and desired to secure by Letters Patent:

1. A signage structure comprising:

a placard support;

a placard slidably mounted in the placard support, the placard including a face and information visible on the face, the placard adjustable within the placard support to present the information for viewing from a plurality of selectable viewing angles; and a bracket coupled to the placard support for mounting the signage structure to a fixed structure, wherein the bracket includes a nominally closed access channel and the bracket flexes to allow passage of the post through the channel for installation of the bracket about the post.

2. A signage structure for mounting to a post, the signage structure comprising:

a placard support;

a bracket coupled to the placard support for mounting the signage structure to the post, the bracket including a nominally closed access channel, wherein the bracket flexes to allow passage of the post through the channel for installation of the bracket about the post; and a placard slidably mounted in the placard support, the placard including a face and information visible on the face, the placard adjustable within the placard support to present the information for viewing from a plurality of selectable viewing angles.

3. The signage structure of claim 2, wherein the placard support includes a curved track for receiving the placard, and the placard conforms to the curved track.

4. The signage structure of claim 3 wherein the placard is nominally flat and flexes when installed in the curved track to conform to the curved track.

5. The signage structure of claim 2 wherein the placard support curves to subtend substantially a full circle and the viewing angles are selectable throughout the substantially full circle.

6. A signage structure for mounting to a post, the signage structure comprising:

a placard support having an upper and a lower curved groove;

a bracket coupled to the placard support, wherein the bracket includes a nominally closed access channel and the bracket flexes to allow passage of the post through the channel for installation of the bracket about the post, and wherein the bracket includes a set screw adjustable to grip without piercing the post; and a placard slidably mounted in the curved tracks of the placard support, the placard including a face and information visible on the face, the placard adjustable within the placard support while the placard support is mounted to the post to present the information for viewing from a plurality of selectable viewing angles.

* * * * *